US006507968B1

(12) United States Patent
Hansen

(10) Patent No.: US 6,507,968 B1
(45) Date of Patent: Jan. 21, 2003

(54) SIDE SKIRT FOR A SURFACE TREATING APPARATUS

(75) Inventor: Karl Hansen, Cottage Grove, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 09/656,774

(22) Filed: Sep. 7, 2000

(51) Int. Cl.[7] ..... A47L 11/00; E01H 1/05; E01H 1/08

(52) U.S. Cl. ..... 15/49.1; 15/50.3; 15/82; 15/98; 15/340.3

(58) Field of Search ..... 15/49.1, 50.1, 15/50.3, 52.1, 55, 78, 82–86, 98, 320, 340.1–340.9, 345, 346; 180/127

(56) References Cited

U.S. PATENT DOCUMENTS

| | | | |
|---|---|---|---|
| 3,186,021 A | | 6/1965 | Krier et al. |
| 3,327,797 A | * | 6/1967 | Bertin |
| 3,425,082 A | | 2/1969 | Hetman |
| 3,512,604 A | * | 5/1970 | Giraud |
| 3,726,493 A | * | 4/1973 | Muller |
| 3,837,038 A | | 9/1974 | Kimzey et al. |
| 3,881,215 A | | 5/1975 | Krier et al. |
| 3,892,008 A | | 7/1975 | Christensen et al. |
| 4,320,556 A | | 3/1982 | Kimzey et al. |
| 4,951,347 A | | 8/1990 | Star et al. |
| 5,239,720 A | | 8/1993 | Wood et al. |
| 5,303,448 A | | 4/1994 | Hennessey et al. |
| 5,394,586 A | | 3/1995 | Holley |
| 5,542,148 A | | 8/1996 | Young |
| 5,588,176 A | | 12/1996 | Sixsmith |
| 5,659,921 A | | 8/1997 | Narayan |
| 5,884,359 A | | 3/1999 | Libhart |
| 6,018,844 A | | 2/2000 | Basham et al. |

OTHER PUBLICATIONS

International Search Report PCT/US01/28073, six pages, dated Apr. 5, 2002.

* cited by examiner

*Primary Examiner*—Terrance R. Till
(74) *Attorney, Agent, or Firm*—Fulbright & Jaworski L.L.P.

(57) ABSTRACT

An air barrier or skirt apparatus for a surface treating machine having a brush chamber and a rotatable brush substantially disposed within the brush chamber. The air barrier or skirt apparatus is disposed adjacent either end of the rotatable brush and extend from the brush chamber to a surface to be cleaned. The air barrier or skirt apparatus comprises an inner flexible member and an outer flexible member. The inner flexible member and the outer flexible member are coupled to each other at predetermined attachment regions, with the predetermined attachment regions defining first and second dimensions on the inner and outer flexible members, respectively. The first dimension of the inner flexible member is less than the second dimension of the outer flexible member, so that when the inner and outer flexible members are coupled to each other at the predetermined attachment regions the inner flexible member is formed into a non-planar configuration. A method of fabricating such a skirt apparatus is also disclosed.

20 Claims, 7 Drawing Sheets

SIDE SKIRT FOR A SURFACE TREATING APPARATUS

BACKGROUND OF THE INVENTION

This invention relates generally to floor treating and conditioning machines and in particular to a side skirt air barrier for use on a floor sweeping and/or cleaning machine.

Machines which prepare and treat surfaces by sweeping, and/or cleaning are known in the art (see, for example, U.S. Pat. Nos. 3,892,008 and 5,394,586). Such machines often include a rotary brush or brushes which are used to sweep particulate matter and debris into a collection chamber or chambers. The rotary brush or brushes are usually positioned so that a portion of the brush or brushes extend beyond a protective housing and towards a surface to be treated. During operation of such machines, lightweight particulate matter is often admixed in to the atmosphere and expelled beyond the confines of the bodies of the machines in an action commonly known as dusting and/or deposited in debris trails along the sides of the machines in an action commonly known as side trailing.

Various devices have been developed to minimize dusting and side trailing, most notably with the provision of air handling units and skirting. The inclusion of an air handling unit such as a fan is used to create and maintain a relatively negative pressure differential in and around the rotary brush housing. Typically, such a negative pressure differential induces ambient, external air to flow from the area adjacent the brush housing through a series of collection chambers and filters located within the surface treating machine. While this reduces the amount of dusting and side trailing by a substantial amount, significant amounts of dusting and side trailing may be generated when the air flow induced by the fan is overwhelmed by localized positive pressure differential areas generated by the brush as it contacts a surface. As a result, dusting and side trailing may occur at the ends of the brush.

Side skirts and other air barriers have been devised to minimize the effect of the aforementioned localized positive pressure areas. Typically, side skirts comprise relatively flexible planar members which are positioned proximate the ends of a brush. These skirts have drawbacks, however. Thick skirts do not easily deflect when encountering obstructions. As a result, they are subject to tearing and misalignment. And, thin skirts tend to become warped due to contact with surfaces to be treated.

More recently, side skirting has been improved (see, for example, U.S. Pat. No. 6,018,844 assigned to the Tennant Company, assignee herein). Such side skirting comprises a plurality of layers of relatively flexible material which are attached to each other by elastic spacer elements in a parallel relationship. The use of flexible material in the aforementioned side skirt permits more intimate contact with surfaces to be cleaned. An advantage of such close contact is that dusting and debris trail formation are reduced and the efficiency of the attendant suction fan is increased. A feature of the aforementioned skirt is that it is positioned so that it angles inwardly toward a surface to be treated. This position presents an angled planar surface which assists in directing debris into the air flow generated by the fan. Another feature of the skirt is that the elastic spacer elements allow the skirt to be momentarily deflected as is passes over and by relatively immovable objects. Coincident with this feature of the skirt is that it includes a channel located between and formed by the elastic spacer elements. The channel assists in directing the flow of air generated by a suction fan into collection chambers in the machine.

This skirt is not without drawbacks, however. In order to operate as intended, the air channels must be sufficiently wide to allow an effective amount of air to pass therethrough. This results in a relatively thick assembly which adds to the overall width of the machine. Ancillary to this drawback is that such an assembly requires the use of specially designed, angled bracket which adds to the overall width of the machine. Yet another drawback is that fabrication is rather complicated. Still another drawback is that the inclusion of an air channel effectively limits the fabrication of such a skirt assembly into relatively simple and inefficient planar configurations.

There is a need for a side skirt which may be easily fabricated, have a relatively thin profile, and which may be formed into a variety of configurations.

SUMMARY OF THE INVENTION

A skirt apparatus or air barrier for use with a surface treating apparatus of the type having at least one movable implement substantially disposed within a housing. The skirt includes a first or inner flexible, member and a second or outer flexible member. The first and second flexible members are coupled to each other in such a manner as to impart a non-planar shape to the first member. The non-planar shape is achieved by differentially coupling the first and second members together. This is accomplished by predetermining a plurality of attachment regions for each of the inner and outer members and then coupling the inner and outer members together at their respective attachment regions. The particular attachment regions may be located at various locations and be of a particular shape and size, depending upon the desired configuration desired. Preferably, the inner and outer members are formed from rubber or rubber-like material with the outer member being slightly thicker than the inner member. The resulting assembled skirt has an inherent flexibility that allows it to be momentarily deflected as it passes over and by relatively immovable objects.

An object of the present invention is to simplify assembly of a skirt.

Another object of the present invention is to increase the number of configurations into which a skirt may be formed.

Yet another object of the present invention is to reduce the number of components used to fabricate a skirt.

Still another object of the present invention is to increase the efficiency by which a skirt directs airflow around an implement housing of a surface treatment apparatus.

A feature of the present invention is the use of two flexible members, attached to each other at predetermined regions, to create a skirt with a non-planar configuration.

Another feature of the present invention is that attachment of the skirt to a surface treating apparatus is simplified and results in a more compact structure.

Another feature of the present invention is that an assembled skirt has inherent flexibility to enable it to be momentarily deflected as is passes over and by a relatively immovable object.

An advantage of the present invention is that fabrication is accomplished with a minimum number of parts.

These, and other objects, features and advantages will become more readily apparent to those skilled in the art from the detailed description and the accompanying drawings.

DETAILED DESCRIPTION OF THE DRAWINGS

Figure 1:
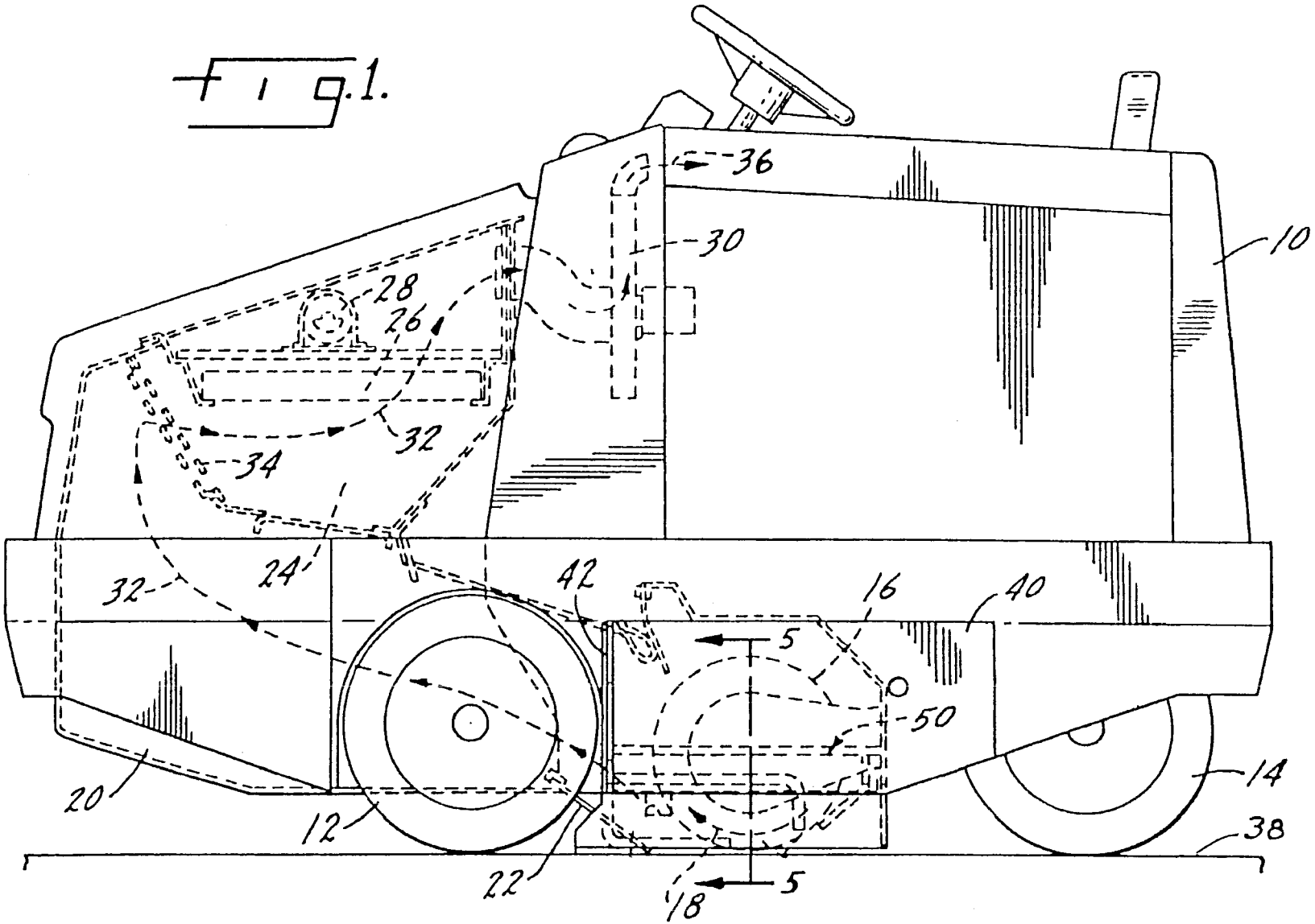
FIG. 1 is a side plan view of a surface treating apparatus with a treatment implement and components ancillary to the treating implement shown in phantom.

Referring to the drawings generally and FIG. 1 in particular, FIG. 1 depicts a surface treating machine is indicated to have a body shown generally at 10, and support wheels 12 and 14. Within the machine 10 there is a rotatable brush 16 which extends transversely across the body of the machine and, as illustrated by the arrow 18, will be rotated in a direction which directs dust and debris forwardly into a debris collection chamber or hopper indicated generally at 20. Forward of the rotatable brush 16, is a ramp or chute 22 which defines the entrance to the debris collection chamber 20, with the debris collection chamber being located forward of the brush as is customary in sweeping machines of this type. Positioned above and slightly forward of the debris collection chamber 20 is a dust collection chamber 24 having a filter assembly 26 therein, with the filter assembly having a movable shaker 28 mounted thereon. Further details of the sweeper are shown in U.S. Pat. Nos. 5,303,448 and 5,659,921, assigned to Tennant Company of Minneapolis, Minn., with the disclosure of both the patents being incorporated herein by reference.

Above and to the rear of the dust collection chamber 24 is a vacuum fan indicated diagrammatically at 30, with the vacuum fan creating an air flow path indicated by the series of arrows designated at 32. The air flow path begins proximate the rotatable brush 16, passes through the debris collection chamber 20, then through a series of baffles 34 into the dust collection chamber 24. The air flow path then passes through the filter 26 and exhausts from the vacuum fan 30 as illustrated by arrows 36. The described dust control system is conventional in sweeping machines of this type.

Figure 2:
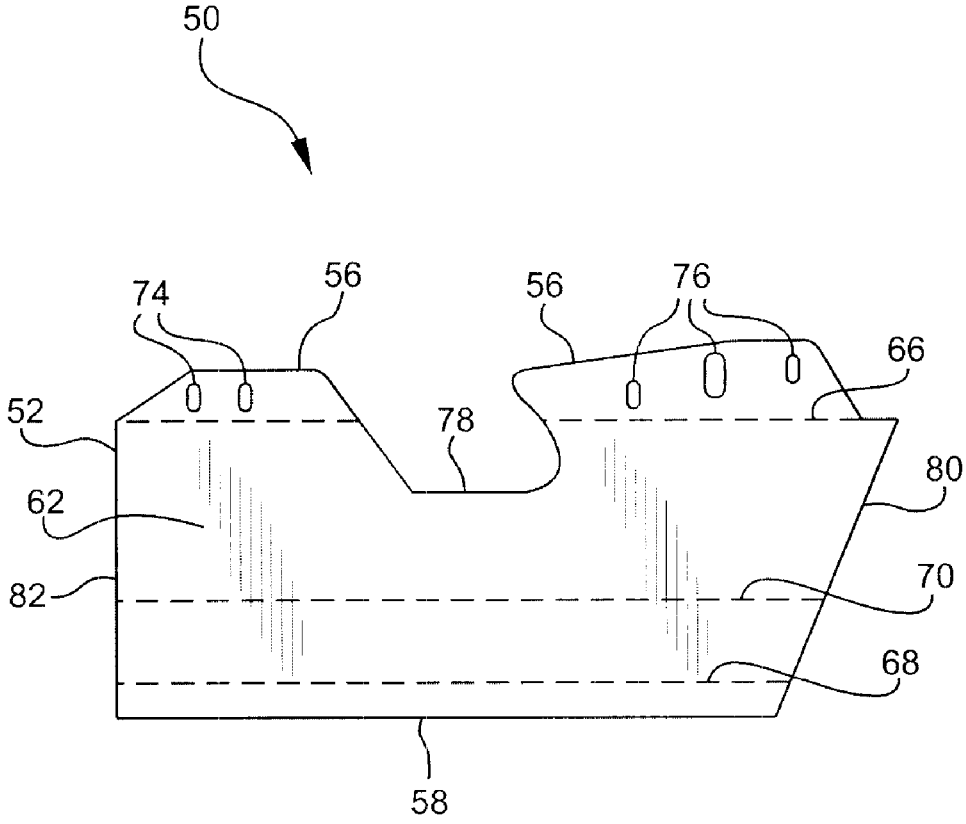
FIG. 2 is a plan view of a right side skirt apparatus showing attachment regions and a mounting arrangement.
Figure 5:
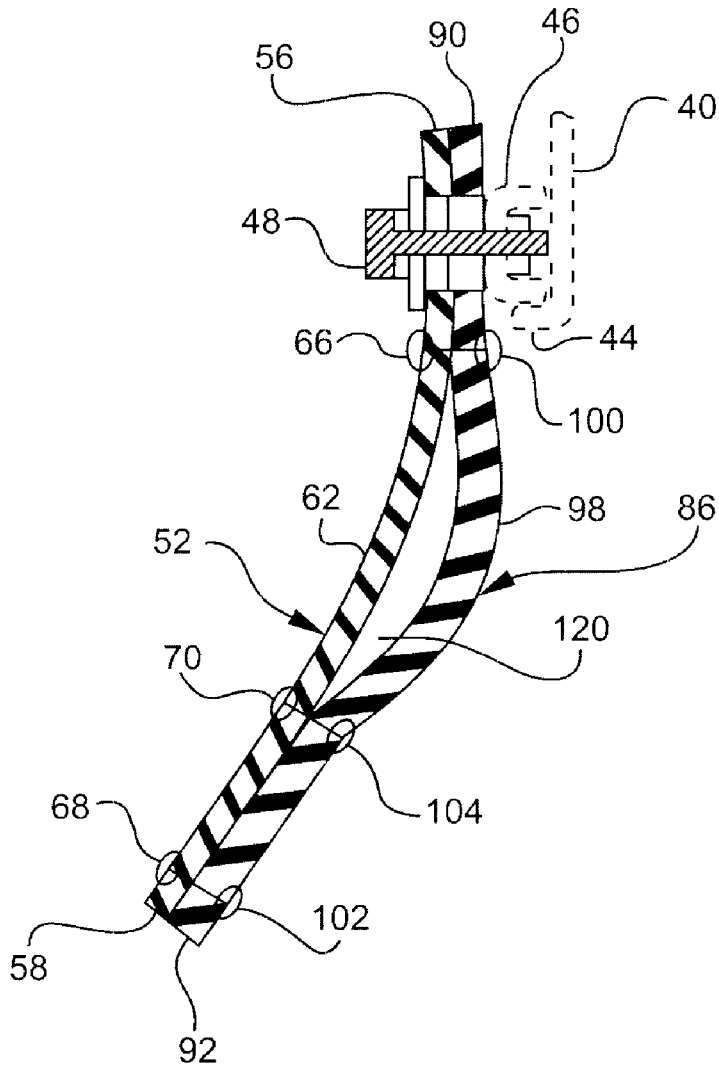
FIG. 5 is a sectional edge view along plane 5—5 of FIG. 1.

As shown in FIGS. 1, 2 and 5, a side skirt apparatus or air barrier assembly is preferably attached to a door 40 which is hinged along a front edge 42 and which covers one end of the rotatable brush 16. While the preferred embodiment illustrates a side skirt apparatus, additional applications for the air barrier may exist, e.g., sealing between air ducts, etc. The door 40 provides access to the rotatable brush 16 and the other interior components of the machine 10 for maintenance and cleaning. The door 40 is configured to support a side skirt assembly of the present invention through the use of an inwardly extending flange 44 and associated bracket 46. Bolts or other suitable types of fasteners indicated at 48 attach the side skirt assembly indicated generally at 50 to the bracket 46 through appropriately sized apertures or slots (see 74 and 104 in FIG. 3) located adjacent upper edges (see 56 and 86 in FIG. 3) of the assembly 50. The slots allow the side skirt assembly to be adjustably positioned relative to a surface to be cleaned 38. While only one side skirt assembly and one door are described, it is understood that there may be another side skirt assembly and associated door adjacent the other end of the rotary brush.

Figure 6A:
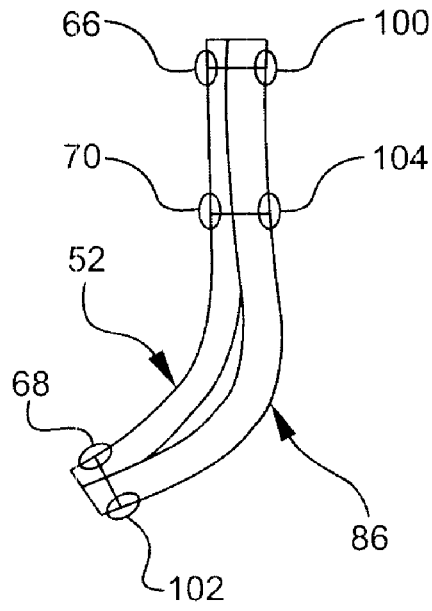
FIG. 6A is an edge view of a skirt apparatus illustrating a non-planar configuration and a mechanical fastener used to couple the first and second members together.
Figure 6B:
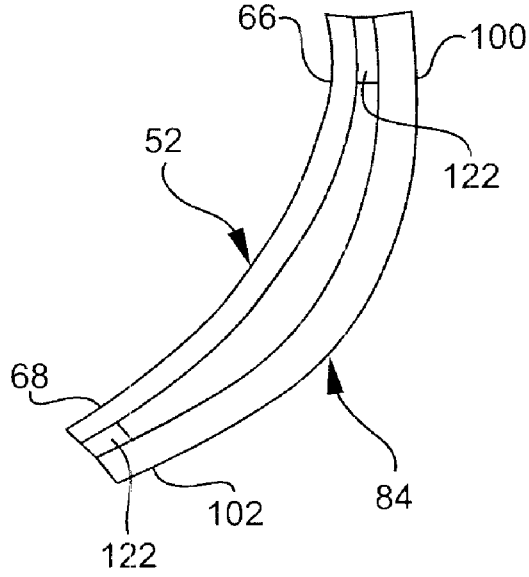
FIG. 6B is an edge view of a skirt apparatus illustrating an alternative non-planar configuration and adhesive material used to couple the first and second members together; and, FIG. 6C is an edge view of a skirt apparatus illustrating an alternative non-planar configuration and the use of weldments to couple the first and second members together.
Figure 6C:
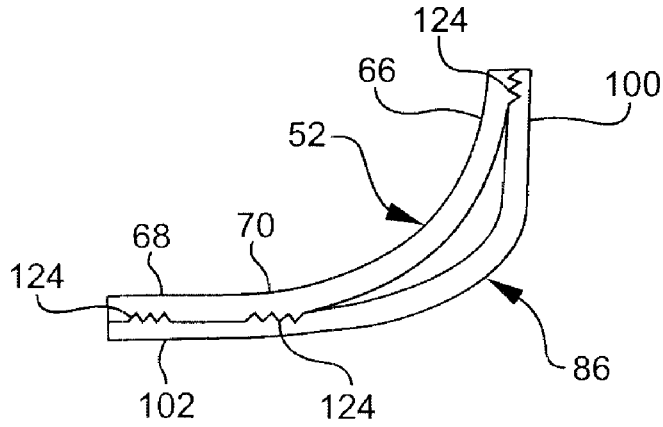
FIG. 6D is an edge view of an alternative embodiment of a skirt apparatus in which a third member is interposed between the inner and outer members of the skirt.

The side skirt assembly or apparatus 50 includes an inner member 52 and an outer member 86 which are coupled to each other in a predetermined fashion. While the preferred embodiment depicts stitching to couple the inner and outer members together (see FIG. 2), it is understood that other mechanical fasteners such as rivets, staples, hook and loop fasteners, bands, or their equivalents may be used. Alternatively, adhesive material (see 122 as depicted in FIG. 6B) or welding (see 124 as depicted in FIG. 6C) may be used. It is also understood that term welding may include attachment by sonic waves, ultrasonic waves, infrared waves, microwaves, heat, or their equivalents. Preferably, thread is used. In the preferred embodiment, the inner and outer members 52, 86 are formed of neoprene which has an internal fabric reinforcing layer. However, it is understood that other materials which are sufficiently flexible and resilient to create the invention may be used. Such material may include, for example, plastics and metal such as spring steel.

Figure 3:
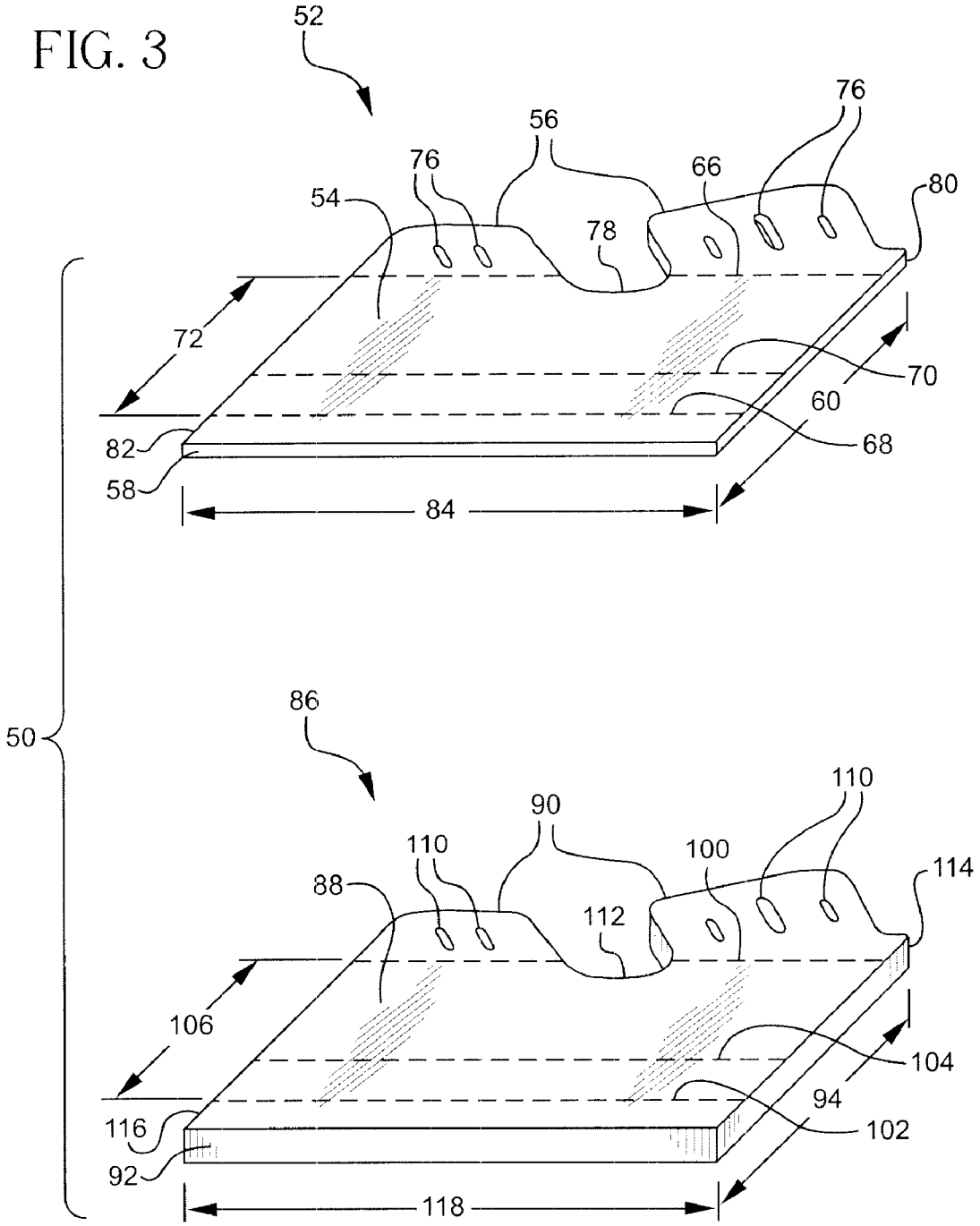
FIG. 3 is an exploded, perspective view of a skirt apparatus illustrating an inner member positioned above an outer member.

As shown in FIG. 3, the inner member 52 and the outer member 86 of the skirt assembly 50 have substantially the same configuration. That is, both the inner and outer members 52, 86 have a main body 54, 88, having upper edges 56, 90, lower edges 58, 92, apertures/slots 74, 110, and notches 76, 112, respectively. The members 52, 86 also have predetermined attachment regions. It is important to note that the attachment regions define dimensions, and that the dimension differ between the inner and outer members. It is the difference in the dimensions of the inner and outer members that allows the skirt assembly or apparatus to be configured into non-planar configurations. As depicted in FIGS. 1, 3 and 5, there is a first attachment region, a second attachment region and a third attachment region. In order for the skirt apparatus to be configured into a non-planar configuration, two of the dimensions between two attachment regions must be different. As shown in FIG. 3, the distance between the first and second attachment regions of the inner member defines a first dimension, while the distance between the first and second attachment regions of the outer member define a second dimension. When the inner and outer members are attached to each other at their respective first and second attachment regions, the member with the larger dimension will cause the member with the smaller dimension to bend. In the preferred embodiment, the dimension of the outer member is larger than the dimension of the inner member, thus forming the skirt assembly into the non-planar configuration of an arc.

Figure 4:
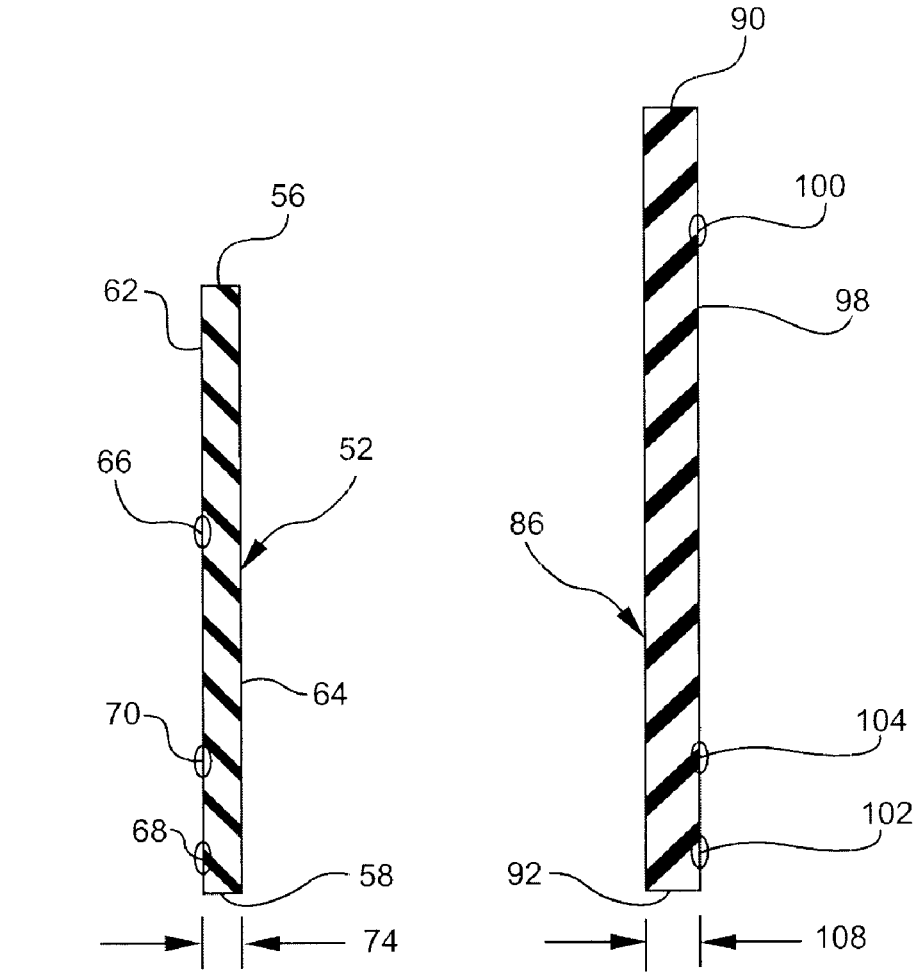
FIG. 4 is an edge view of the inner member in juxtaposition with the outer member, prior to assembly.

To better illustrate the concept of offset or differential attachment, FIGS. 4 and 5 show an exaggerated side view of an inner member 52 and an outer member 86 in juxtaposition prior to assembly, and post assembly. Since the skirt configuration has been predetermined (see FIG. 5), it necessarily follows that the attachment regions are also predetermined. Thus, inner member 52 has a first attachment region 64, a second attachment region 66 and a third attachment region 68, while the outer member has a corresponding first attachment region 100, a second attachment region 102 and a third attachment region 104. Note, that prior to assembly the distance between the first attachment region 64 and the second attachment region 66 of the inner member is greater than the distance between the first attachment region 100 and the second attachment region 102 of the outer member. Further note, that post assembly (as shown in FIG. 5), the first, second, and third attachment regions of the respective inner and outer members have been brought into alignment with each other. This alignment creates a cavity 120 between the surfaces 64, 96 of the inner and outer members 52, 86, respectively. As can be seen in FIG. 5, the thickness 108 of the outer member 86 is greater than the thickness 74 of the inner member 52. This is to provide sufficient support and strength to the skirt apparatus. Preferably, the thickness of the outer member is about twice that of the thickness of the inner member. And more preferably around 0.125 inches for the outer member and around 0.062 inches for the inner member.

As mentioned above, the attachment regions are variable, dependent on the particular application and use. Hence, the term attachment region is understood to include a singular point, a plurality of points, a line, or an area. In the preferred embodiment (as best shown in FIGS. 2, 3, and 5), the attachment regions extend between the forward edges 80, 114 and trailing edges 82, 116 of the inner and outer members 52, 86, respectively, along the longitudinal extent. Preferably, the attachment region is generally linear. Other non-planar configurations are possible.

Figure 6D:
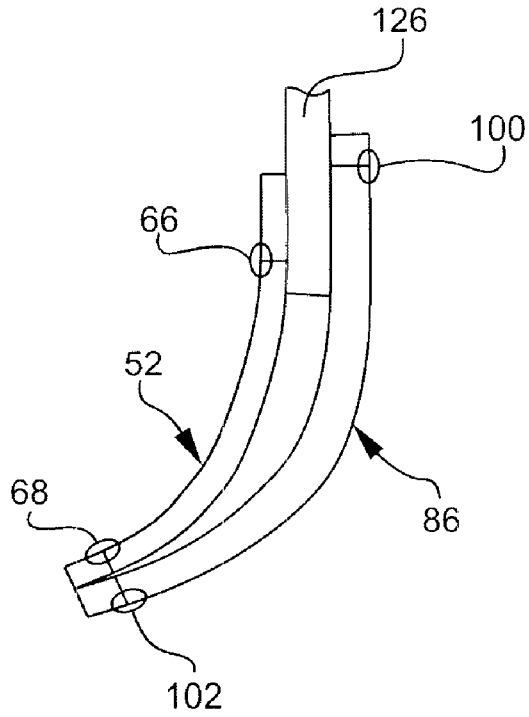

In an alternative embodiment, FIG. 6D depicts a skirt apparatus in which the inner and outer members are attached in a slightly different manner. Here, the inner and outer members 52, 86 are indirectly coupled to each other at respective first attachment regions 66 and 100, respectively, by a third member 126, and directly coupled to each other at respective second attachment regions 68 and 102. The third member 126 may be an additional flexible member, or a portion of the surface treatment apparatus, or a portion of a bracket, or any other desirable structure.

Methods of fabricating the skirting will now be discussed. Initially, the dimensions of a skirt are dictated by use and function which may be broken down into variables such as, the particular machine or apparatus on which a skirt is to be installed, the extent to which such a skirt will be used (i.e., one side, two sides, three sides, etc.) and the particular configuration of the inner member. These factors are straight forward and will not be discussed in detail. Once these and other variables have been taken into account, fabrication may begin. Generally, the configuration of the skirt assembly is of the greatest concern, as it is often easier to couple the inner and outer members together before finishing as required—rather than the other way around.

The preferred embodiment, however, differs slightly from this process. Here, it is desired to fabricate a skirt assembly in which the inner member has an arcuately shaped configuration and in which the upper and lower edges of the inner and outer members are adjacent each other. In order for these parameters to be achieved, the distance between the upper and lower edges of the outer member must be greater than the distance between the upper and lower edges of the inner member. It is this distance, along with the particular attachment regions determines the shape of the resultant arc.

Assembly of the preferred embodiment is straight forward. First, the inner and outer members are formed to the desired width. As discussed above, the width of the outer member will be greater than the width of the inner member. The inner and outer members are then positioned adjacent each other and either the upper or lower edges of the inner and outer members are brought into alignment with each other. The inner and outer members are then coupled to each other at their aligned edge, in this instance adjacent their upper edges. Coupling is preferably by stitching and preferably along the longitudinal extent of the inner and outer members. Then the edges opposite the attached edges are brought into alignment with each other and the inner and outer members are coupled to each other at this second aligned edge, in this instance the lower edges. Then, depending upon the configuration desired, the inner and outer members are coupled to each other at respective third predetermined attachment regions in the same manner as discussed above. Note, in the preferred embodiment that the second surface of the inner member and the first surface of the outer member are substantially in contact with each other in the area between the second and third attachment regions, while the second surface of the inner member and the first surface of the outer member are spaced apart from each other in the area between the first and third attachment regions, to form a cavity. After the inner and outer member have been coupled to each other, the skirt apparatus or assembly may be finished as required. Finishing may include additional steps such as: trimming the skirt to a particular length; removing portions of the skirt apparatus to create apertures or slots adjacent the upper edges of the inner and outer members; and, removing portion(s) of the skirt apparatus to form notches or cutouts.

The present invention may be embodied in other specific forms without departing from the spirit or essential attributes thereof; and it is, therefore, desired that the present embodiment be considered in all respects as illustrative and not restrictive, reference being made to the appended claims rather that to the foregoing description to indicate the scope of the invention.

The invention claimed is:

1. A skirt apparatus for a surface treating apparatus, said skirt apparatus comprising:

a flexible inner member having an upper edge and a lower edge, with the upper and lower edges spaced apart from each other by a predetermined distance; the inner member including a first attachment region and a second attachment region, with the first and second attachment regions spaced apart from each other by a first predetermined dimension, and, a flexible outer member having an upper edge and a lower edge, with the upper and lower edges spaced apart from each other by a predetermined distance, with the outer member including a first attachment region and a second attachment region, with the first and second attachment regions being spaced apart from each other by a second predetermined dimension greater than the first predetermined dimension and wherein each of the first and second attachment regions of the inner member and the outer member is generally linear, with the inner and outer members being coupled to each other at their respective first and second attachment regions, and wherein the skirt apparatus is coupled to the surface treating apparatus proximate to the upper edges of the inner and outer members, and wherein a lower edge of the skirt apparatus is substantially free to contact a ground surface and deflect in response to surface irregularities of the ground surface.

2. The skirt apparatus according to claim 1, wherein the first predetermined dimension is less than the second predetermined dimension, and, wherein the outer member biases the inner member into a non-planar configuration.

3. The skirt apparatus according to claim 2, wherein the distance between the upper and lower edges of the outer member is greater than the distance between the upper and lower edges of the inner member; and, wherein the first and second attachment regions are proximate the upper and lower edges of the inner and outer members, respectively.

4. The skirt apparatus according to claim 3, wherein the inner and outer members are coupled to each other along their respective attachment regions by adhesive material.

5. The skirt apparatus according to claim 3, wherein the inner and outer members are coupled to each along their respective attachment regions by welding.

6. The skirt apparatus according to claim 2, wherein the inner and outer members are coupled to each other along their respective attachment regions by at least one mechanical fastener.

7. The skirt apparatus according to claimed 6, wherein the mechanical fastener is thread.

8. The skirt apparatus according to claim 2, wherein the non-planar configuration is arcuate.

9. The skirt apparatus according to claim 1, wherein the inner member has a first thickness and the outer member has a second thickness, with the second thickness being equal to or greater than the first thickness.

10. The skirt apparatus according to claim 1, wherein the inner member has a first resiliency and the outer member has a second resiliency, with the second resiliency being equal to or greater than the first resiliency.

11. An air barrier for a surface treating apparatus, said air barrier comprising:

a first flexible member having at least one first attachment region and at least one second attachment region, with the first attachment region and the second attachment region defining a first dimension; and, a second flexible member having at least one first attachment region and at least one second attachment region, with the first attachment region and the second attachment region defining a second dimension, with the second dimension greater than the first dimension, with the first and second members attached to each other at their respective first and second attachment regions, wherein each of the first and second attachment regions of the first and second members is generally linear, and wherein the air barrier is coupled to the surface treating apparatus proximate to the upper edges of the inner and outer members, and wherein a lower edge of the air barrier is substantially free to contact a ground surface and deflect in response to surface irregularities of the ground surface.

12. The air barrier according to claim 11, wherein the attachment regions of the first and second members are parallel.

13. An air barrier comprising:

a first flexible member having at least one first attachment region and at least one second attachment region, with the first attachment region and the second attachment region defining a first dimension; and, a second flexible member having at least one first attachment region and at least one second attachment region, with the first attachment region and the second attachment region defining a second dimension, with the second dimension greater than the first dimension, with the first and second members attached to each other at their respective first and second attachment regions, wherein each of the first and second attachment regions of the first and second members is generally linear;

the first and second members including a third attachment region.

14. The air barrier according to claim 13, wherein the third attachment region of each of the first and second members is linear.

15. The air barrier according to claim 13, wherein the third attachment regions of the first and second members are parallel to the first and second regions of the first and second members, respectively.

16. A method of making and utilizing a skirt for a surface treating apparatus of the type having a movable implement substantially disposed within a housing, the method comprising the steps of:

a. selecting a first member having opposing edges spaced apart from each other by a first predetermined distance, said first member having at least one first attachment region and at least one second attachment region, said at least one first attachment region and second attachment region being generally linear;

b. selecting a second member having opposing edges spaced apart from each other by a second predetermined distance, wherein the second predetermined distance is greater than the first predetermined distance, said second member having at least one first attachment region and at least one second attachment region, said at least one first attachment region and second attachment region being generally linear;

c. placing the second member in contact with the first member;

d. aligning the opposing edges of the first and second members so that they are coincident with each other;

e. attaching the first member to the second member with the first and second members attached to each other at their respective first and second attachment regions; and f. attaching the skirt to the surface treating apparatus proximate to the first attachment regions of the inner and outer members, and wherein a free end of the skirt is in contact with a ground surface and can deflect in response to surface irregularities of the ground surface.

17. The method of claim 16, wherein the step of coupling comprises sewing.

18. A method of making and utilizing an air barrier for a surface treating apparatus, said method comprising the steps of:

a. selecting first and second flexible members to form an air barrier having a first end and a second end;

b. determining first and second attachment regions for the first and second flexible members, respectively, each of said first and second attachment regions being generally linear;

c. aligning the first and second attachment regions of the first and second members so that they are coincident with each other;

d. coupling the first member to the second member at their first and second attachment regions, respectively to a non-planar shape; and e. coupling the air barrier to surface treating apparatus at its first end, said second end being free to contact a floor surface and deflect in response to surface irregularities in the floor surface.

19. A skirt for use with a surface treating apparatus of the type having a movable implement substantially disposed within a housing, the skirt releasably attached to the apparatus and extending beyond the housing towards a surface to be treated, the skirt comprising:

a first flexible member having an upper edge and a lower edge, the skirt having a first end and a second end, said skirt having at least one first attachment region and at least one second attachment region with the at least first attachment region being closer to the upper edge than the second attachment region, said at least one first attachment region and second attachment region being generally linear and said at least one first attachment region and second attachment region defining a first predetermined dimension;

a second flexible member having an upper edge and a lower edge, the skirt having at least one first attachment region and at least one second attachment region, with the at least first attachment region being closer to the upper edges than the second attachment region, said at least one first attachment region and second attachment region being generally linear and said at least one first attachment region and second attachment region defining a second predetermined dimension greater than the first predetermined dimension, with the second flexible member attached to the first flexible member at their respective second attachment regions; and, a third member, the third member operatively connected to the first attachment regions of the first and second flexible members, respectively, so that a portion of the first and second flexible members are in a spaced-apart relation, said skirt being attached to the surface treating apparatus at its first end and the second end being free to contact a floor surface and deflect in response to surface irregularities in the floor surface.

20. The skirt according to claim 19, wherein the third member is positioned between the first and second flexible members.

* * * * *